US007126445B1

(12) United States Patent
McMahon et al.

(10) Patent No.: US 7,126,445 B1
(45) Date of Patent: Oct. 24, 2006

(54) ARC-FAULT DETECTING CIRCUIT-BREAKER SYSTEM WITH STATUS INDICATOR STRUCTURE

(75) Inventors: Roy P. McMahon, Indianapolis, IN (US); John R. Archer, Indianapolis, IN (US)

(73) Assignee: Raytheon Company, Waltham, MA (US)

( * ) Notice: Subject to any disclaimer, the term of this patent is extended or adjusted under 35 U.S.C. 154(b) by 340 days.

(21) Appl. No.: 10/419,573

(22) Filed: Apr. 21, 2003

(51) Int. Cl.
*H01H 73/12* (2006.01)

(52) U.S. Cl. ..... 335/17

(58) Field of Classification Search ..... 335/664; 340/650, 638; 361/93.1, 93.5, 42, 45–46, 361/49, 50
See application file for complete search history.

(56) References Cited

U.S. PATENT DOCUMENTS

| | | | | |
|---|---|---|---|---|
| 4,822,983 A * | 4/1989 | Bremner et al. | 219/505 |
| 5,224,006 A * | 6/1993 | MacKenzie et al. | 361/45 |
| 5,886,641 A * | 3/1999 | Ulerich et al. | 340/638 |
| 5,966,281 A | 10/1999 | Larson | 361/103 |
| 6,198,611 B1 | 3/2001 | Macbeth | 361/42 |
| 6,522,228 B1 * | 2/2003 | Wellner et al. | 335/18 |
| 6,532,140 B1 | 3/2003 | McMahon et al. | |
| 2004/0070898 A1 | 4/2004 | McMahon et al. | |

FOREIGN PATENT DOCUMENTS

| | | |
|---|---|---|
| EP | 0510795 A | 10/1992 |
| WO | WO 0008663 | 2/2000 |

* cited by examiner

*Primary Examiner*—Adolf Deneke Berhane
*Assistant Examiner*—Robert T. Dang
(74) *Attorney, Agent, or Firm*—Daly, Crowley, Mofford & Durkee, LLP

(57) ABSTRACT

An arc-fault detecting circuit-breaker system is used in conjunction with a protected electrical circuit whose current flow is to be interrupted upon the occurrence of an overcurrent fault or an arc fault. The arc-fault detecting circuit breaker system includes a normally closed circuit breaker, an arc-fault detector of the occurrence of an arc fault in the protected electrical circuit, and a circuit-breaker activating element operable responsive to the detector. The circuit-breaker activating element opens the circuit breaker in the event that the detector detects an arc fault in the protected electrical circuit. A status indicator structure, preferably in the form of a two-part pop-up button, has a first status indicator element which indicates the opening of the circuit breaker due to the overcurrent fault, and a second status indicator element which indicates the opening of the circuit breaker due to the arc fault.

5 Claims, 4 Drawing Sheets

ARC-FAULT DETECTING CIRCUIT-BREAKER SYSTEM WITH STATUS INDICATOR STRUCTURE

This invention relates to circuit-breaker systems and, more particularly, to an arc-fault detecting circuit-breaker system responsive to the occurrence of both overcurrent and arcing in a protected electrical circuit, and to a status indicator that visually or otherwise indicates the status of the circuit-breaker system.

BACKGROUND OF THE INVENTION

Aircraft electrical systems are normally protected from high current and electrical shorts by circuit breaker devices. These circuit breakers are designed to remove power from a protected electrical circuit if an electrical current above a preset value is passed through the device. The high currents may occur for a number of reasons, such as a failure occurring in a piece of electrical equipment or damage occurring in a section of wiring insulation allowing the conductor to come into electrical contact with the structure of the aircraft, which is normally at ground potential.

Due to the nature of the circuit breaker mechanism, the tripping (opening) of the circuit breaker is not "instantaneous". Some types of circuit breakers are allowed to continue supplying current for up to 40 seconds at twice their specified trip currents. An overload of five times the rated current may be allowed to flow for up to three seconds before a trip must occur. The trip delays are allowed because these devices rely on the overcurrent to heat up a bimetallic strip that functions as the detection element within the circuit breaker.

Circuit breakers conforming to these requirements have been used in aircraft for many years. Under normal operating conditions and under normal fault conditions, they operate satisfactorily. However, there are some fault conditions where the tripping delay greatly affects the ability of the circuit breaker to protect life and property. For example, certain types of wiring failures allow for a fault to ground which is not a "dead short", meaning a direct, virtually zero-resistance electrical connection to ground. Certain types of wiring insulations arc track when electrically faulted, which locally turns the material from an insulator to a conductor. An arc-tracked wire can be shorted to ground through a resistance which serves as a current limiter, which in turn allows the current to flow through the wire to the fault for some time until the circuit breaker is tripped. Until that occurs, the high current flow can damage and arc track other wires, adding their electrical supplies into the fault. This fault may initiate a cascading chain reaction which could quickly compromises the safety of the aircraft.

These types of events occur sufficiently often in aircraft wiring systems that there is a need for a device which can detect arcing faults and remove electrical power from the protected electrical circuit more quickly than can a standard circuit breaker, while at the same time being easily verifiable by operations and maintenance personnel as to the status of the system. It is also useful that the arc detecting device be able to convey to operators and maintainers when an arc fault was detected and caused the opening or tripping of a circuit breaker. This information is important in determining the method of repair and the degree of safety of resetting the device and attempting to re-establish electrical operation. In addition, such a device must meet other requirements, such as space limitations, low cost, and "invisibility" to normal operating conditions of aircraft electrical systems. The present invention fulfills this need, and further provides related advantages.

SUMMARY OF THE INVENTION

The present invention provides an arc-fault detecting circuit-breaker system with an arc fault status indicator and a method for its use. The arc-fault detecting circuit-breaker system has a status indicator structure that allows its status and a cause, if any, of its opening to be readily ascertained during operation and servicing. The arc-fault detecting circuit-breaker system responds both to excessive currents, as does a conventional circuit breaker, and to arc faults (sometimes termed "sparks"), but does not trip as a result of short-duration arcs such as found when a switch is closed. These overcurrent and arc-fault-responsive functions are combined into a single arc-fault detecting circuit-breaker element that allows normal functioning of a protected electrical circuit under ordinary operating circumstances, but responds decisively when a hazardous arc fault occurs. It may be used in circumstances where conventional circuit breakers are now used, but adds the additional capability of arc-fault detection. The arc-fault detecting circuit-breaker system is highly reliable, but fails to a safe state if the arc detection circuit should fail. It is light in weight and small in volume, may be packaged in a manner similar to that of conventional circuit breakers, and is relatively inexpensive. It does not affect the normal operations of the protected electrical circuit.

In accordance with the invention, an arc-fault detecting circuit-breaker system is used in conjunction with a protected electrical circuit whose current flow is to be interrupted upon the occurrence of an overcurrent fault or an arc fault. The arc-fault detecting circuit-breaker system comprises a normally closed circuit breaker in the electrical circuit, an arc-fault detector of the occurrence of an arc fault in the electrical circuit, and a circuit-breaker activating element operable responsive to the detector. Preferably, the circuit-breaker activating element detects a rate of change of current with time in the protected electrical circuit. The circuit-breaker activating element opens the circuit breaker in the event that the detector detects an arc fault in the electrical circuit. A status indicator structure comprises a first status indicator element which indicates the opening of the circuit breaker due to the overcurrent fault, and a second status indicator element which indicates the opening of the circuit breaker due to the arc fault. That is, the status indicator provides an indication of whether the circuit breaker is closed or open and, if open, whether the opening of the circuit breaker was due to an overcurrent condition or an arc fault. The protected electrical circuit operates with either a DC or an AC protected circuit.

In one form, the circuit breaker comprises a movable element that moves between a first position when the circuit breaker is closed and a second position when the circuit breaker is open, and the first status indicator element is movable responsive to the movement of the movable element of the circuit breaker. The second status indicator element is operable responsive to the circuit-breaker activating element. The operation of the circuit-breaker activating element also produces an overcurrent fault in the circuit breaker.

The status indicator structure desirably includes at least a visual status indicator. In one embodiment, the status indicator structure comprises a two-part pop-up button. The first-status-indicator pop-up button is preferably movable responsive to the movement of the movable element of the circuit breaker. The second-status-indicator pop-up button is integral with, but movable relative to, the first-status indicator pop-up button. The second status indicator pop-up button comprises a status indicator shaft movable relative to the first-status indicator pop-up button, a shaft retainer that normally retains the status indicator shaft in a first shaft position, and a shaft activator that moves the status indicator shaft to a second shaft position responsive to the circuit-breaker activating element. The shaft retainer preferably retains the status indicator shaft magnetically. The shaft activator moves the status indicator shaft to the second shaft position responsive to the circuit-breaker activating element using a separating driver that releases the status indicator shaft from the shaft retainer responsive to the circuit-breaker activating element, and a spring which biases the status indicator shaft to move away from the shaft retainer.

The status indicator allows a quick determination, such as by a visual inspection, of whether the normally closed circuit breaker is closed or open. If the circuit breaker is open, the status indicator shows whether it was opened as a result of a simple overcurrent fault without an arc fault, or whether it was opened as a result of an arc fault. In many applications, such as aircraft applications, there are multiple circuit breakers protecting corresponding multiple AC or DC electrical circuits. The circuit breakers are usually arranged on a panel for quick assessment of the circuit breaker status. The preferred status indicator in the form of the two-part pop-up button allows operating and maintenance personnel to quickly inspect to determine whether a circuit breaker has opened and, if so, which circuit breaker has opened and the general cause of the opening. The subsequent steps and remedial measures usually depend upon whether the root cause of the opening of the circuit breaker was an overcurrent in the electrical circuit or an arc fault. In the preferred approach, the occurrence of an arc fault generates an overcurrent that opens the circuit breaker, but the status indicator shows the nature of the underlying cause.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
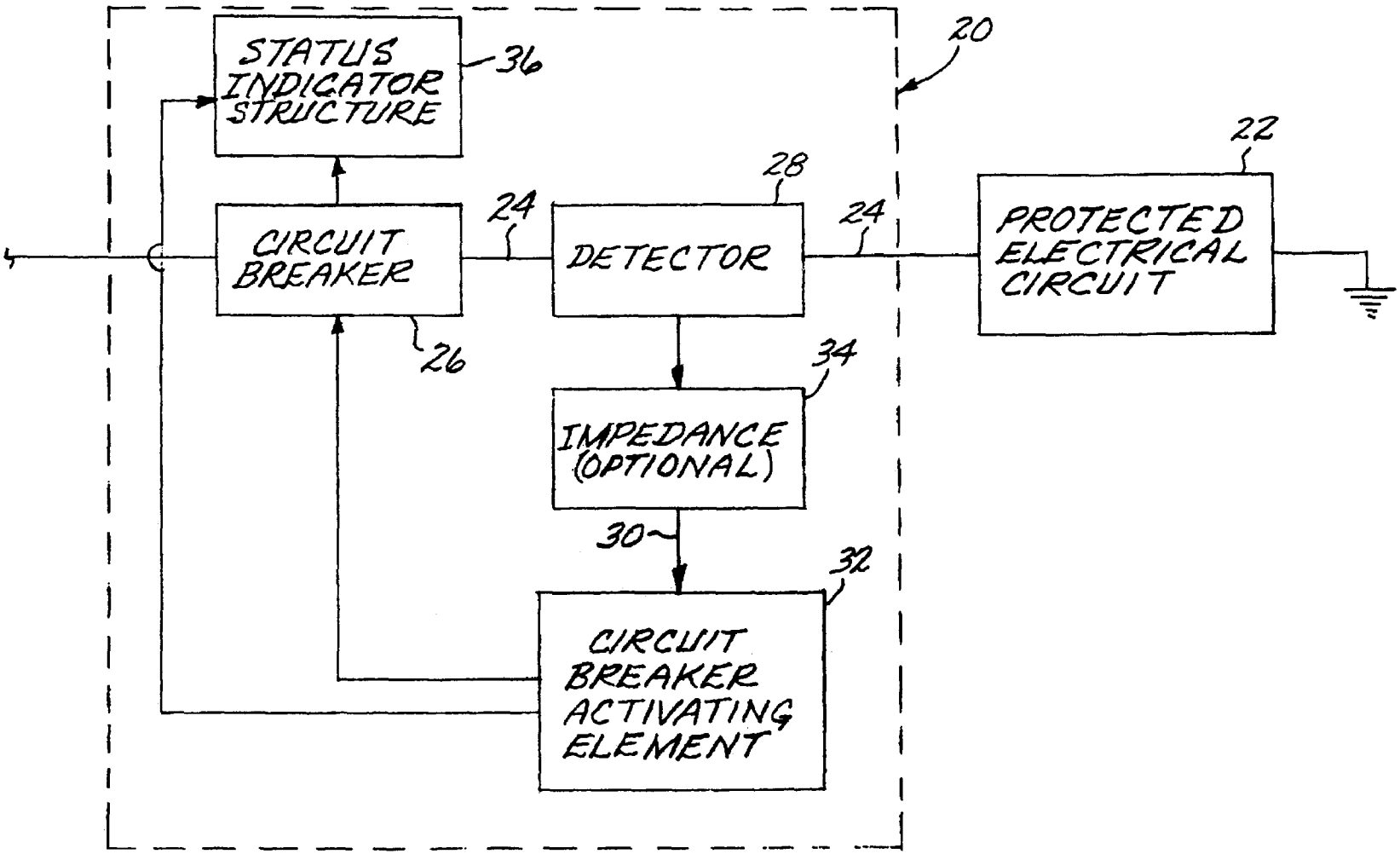
FIG. 1 is a block diagram of a preferred form of the arc-fault detecting circuit-breaker system.

FIG. 1 is a block diagram of an arc-fault detecting circuit-breaker system 20, which serves to protect a protected electrical circuit 22 against overcurrents (excessively high currents) and also against arc faults. The arc-fault detecting circuit-breaker system 20 is illustrated in series with the protected electrical circuit 22 through an electrical line 24.

The arc-fault detecting circuit-breaker system 20 includes a circuit breaker 26, which is typically a resettable circuit breaker. The circuit breaker 26 is a normally closed component sized to allow current flow therethrough up to some selected maximum current, and opens in the event that a higher current is passed therethrough. A conventional resettable circuit breaker is preferably used as the circuit breaker 26, in conjunction with additional circuitry and structure as described subsequently. The circuit breaker 26 functions to automatically interrupt current flow in the electrical line 24 under selected conditions. One of the conditions is the occurrence of an excessively high electrical current (overcurrent) through the electrical line 24. The other of the conditions is the occurrence of an arc fault, sometimes called a sparking condition, which activates (opens or trips) the circuit breaker by the following approach. The circuit breaker 26 may also be opened manually to remove power from the protected electrical circuit 22.

The occurrence of the arc-fault is sensed by a detector 28 which preferably measures the rate of change of electrical current i in the electrical line 24 as a function of time t, or di/dt. An output signal 30 of the detector 28 is supplied to a circuit breaker activating element 32, which indicates a rate of change of current flow, di/dt, greater than a permitted maximum rate-of-change value. This activation temporarily shorts the electrical power directly to ground, increasing the temperature of the current-sensing element of the circuit breaker 26. Multiple, closely spaced output signals 30 of the detector 28 in this manner will cause the circuit breaker 26 to open and will halt any further flow of current to the protected circuit 22.

With this approach, the circuit breaker 26 is responsive to both excessive currents and to excessive rates of change of electrical current with time. The detector 28 acts as a low-pass filter. It responds to fast transients of sufficient amplitude which may have such a small heating value that the standard circuit breaker element cannot respond to them. Slow-rising, low-amplitude events are ignored by the detector 28 and are sensed by the circuit breaker 26.

The mutual impedance of the detector 28 transfers power, with a suitable wave shape, to the circuit breaker activating element 32. This power may be larger than that required to trigger the circuit breaker activating element 32. An impedance 34, such as a resistor, may optionally be inserted into the line carrying the output signal 30 between the detector 28 and the circuit breaker activating element 32 to act as a sensitivity, trigger point, or device-operation equalization control, because the series impedance tends to offset the characteristic variations in the input of the circuit breaker activating element 32.

A status indicator structure 36 operates in conjunction with the arc-fault detecting circuit-breaker system 20 and preferably with the circuit breaker 26. The status indicator structure 36 provides an indication, preferably a visual indication, of the status of the circuit breaker 26, as will be discussed in greater detail subsequently. The circuit breaker 26 and the status indicator structure 36 are preferably mounted to a panel, with a visual display portion of the status indicator structure 36 viewable by operating and maintenance personnel.

Figure 2:
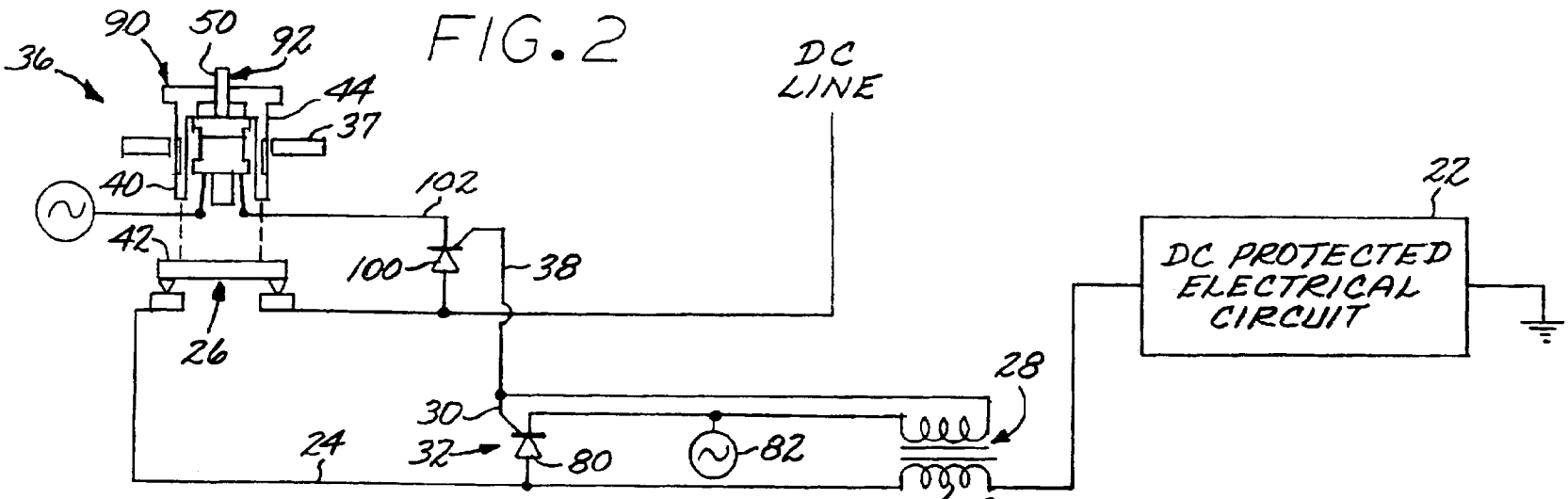
FIG. 2 is a schematic circuit diagram of an embodiment of the arc-fault detecting circuit-breaker system for DC circuit protection.
Figure 3:
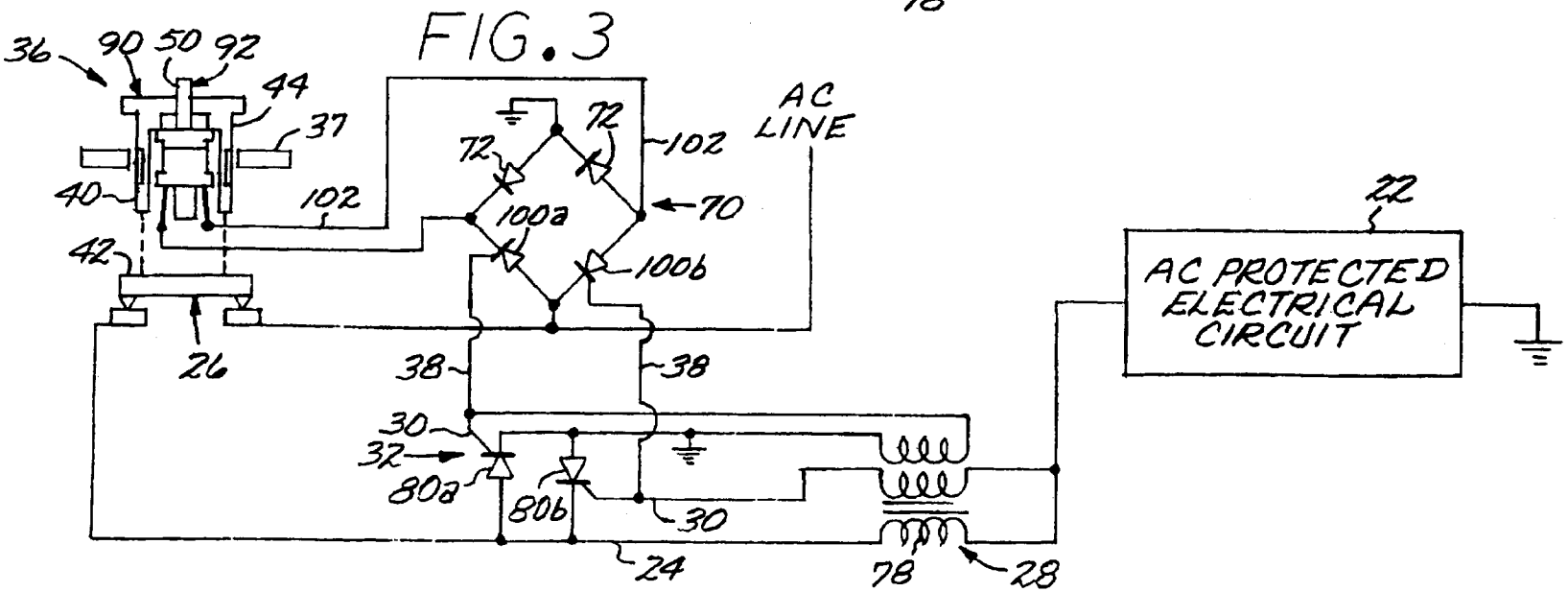
FIG. 3 is a schematic circuit diagram of an embodiment of the arc-fault detecting circuit-breaker system for AC circuit protection.

FIGS. 2–3 illustrate two examples of the arc-fault detecting circuit-breaker system 20 in greater detail. The embodiment of FIG. 2 protects a DC protected electrical circuit, and the embodiment of FIG. 3 protects an AC protected electrical circuit 22. In each case, the detector 28 is illustrated as a transformer 78. The circuit breaker activating element 32 preferably includes a silicon-controlled rectifier (SCR) 80 in the DC embodiment of FIG. 2, or two oppositely connected SCRs 80*a* and 80*b* in the AC embodiment of FIG. 3. The SCR 80 (or 80*a*/80*b*) controllably connects the electrical line 24, at a point between the circuit breaker 26 and the protected electrical circuit 22, to either an AC voltage source 82 in the DC embodiment of FIG. 2 or to ground in the AC embodiment of FIG. 3. There are a number of variations of these two basic approaches, as well as other circuitry, that may also be used to operate the status indicator structure 36. See allowed application Ser. No. 09/585,600, filed Jun. 2, 2000, whose disclosure is incorporated by reference, and application Ser. No. 10/328,658, filed Dec. 23, 2002, whose disclosure is incorporated by reference.

The normally closed circuit breaker 26 may be opened by any of three types of events. First, the normally closed circuit breaker 26 may be opened by an excessively high current through the electrical line 24 resulting from an overcurrent condition in the protected electrical circuit 22, the normal functioning of any circuit breaker. Second, the normally closed circuit breaker 26 may instead be opened by an arc fault detected by the detector 28, whose output signal 30 is applied to the gate of the SCR 80 (or 80*a*/80*b*). When the SCR is activated by the output signal 30 applied to its gate, a large current is drawn through the SCR and thence through the circuit breaker 26, heating its sensing element such that if multiple trigger events occur in rapid succession, the circuit breaker will open and halt the further flow of current to the protected circuit. The status indicator structure 36 visually indicates the opening of the circuit breaker 26, and also visually indicates whether the circuit breaker 26 is open due to an overcurrent condition or the occurrence of an arc fault. Third, the normally closed circuit breaker 26 may be opened manually to intentionally remove power from the protected electrical circuit 22.

The first status indicator structure 36 may be implemented in any operable fashion. In the preferred approach, the status indicator structure 36 includes a mechanical first movement 90 that visually indicates the fact that the circuit breaker 26 is open. This indication is achieved by mechanically connecting the mechanical first movement 90 of the status indicator structure 36 to a movable element 42 of the circuit breaker 26. The movable element 42 moves between a first position (illustrated) when the circuit breaker 26 is closed, to a second position (not illustrated) when the circuit breaker 26 is open. This movement is mechanically communicated into the mechanical first movement 90 of the status indicator structure 36 by a direct mechanical connection in the preferred embodiment. That is, the mechanical first movement 90 when the movable element 42 moves, and vice versa.

The status indicator structure 36 also preferably includes an electromechanical second movement 92 that visually indicates the fact of the opening of the circuit breaker 26 due to the operation of the circuit breaker activating element 32 as a result of the occurrence of an arc fault detected by the detector 28. Preferably, the detector 28 sends its output signal 30 to the gate of the SCR (80 or 80*a*/80*b*) in the circuit breaker activating element 32. This same output signal 30 is tapped as an indicator electrical input signal 38. The indicator electrical input signal 38 may be used directly to activate the electromechanical second movement 92. More preferably, it is used as the gate signal for an indicator SCR 100 (embodiment of FIG. 2) or a bridge 70 formed of indicator SCRs 100*a* and 100*b* and two additional diodes 72 (embodiment of FIG. 3) that use line power to activate the electromechanical second movement 92 with an indicator actuation signal 102.

Figure 4:
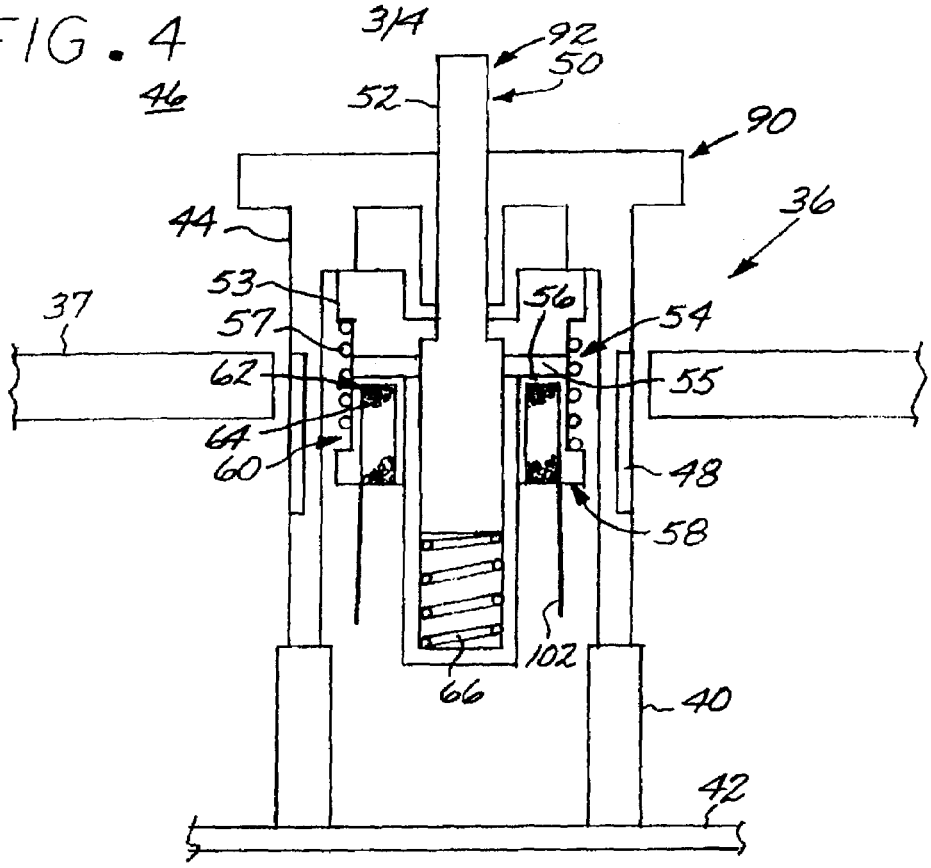
FIGS. 4–6 are schematic sectional views of an embodiment of the pop-up status indicator structure, illustrating the status indicator structure when the circuit breaker is closed (FIG. 4), the status indicator structure when the circuit breaker is open due to an overcurrent or manual opening, but not due to an arc fault (FIG. 5), and the status indicator structure when the circuit breaker is open due to an arc fault (FIG. 6).
Figure 5:
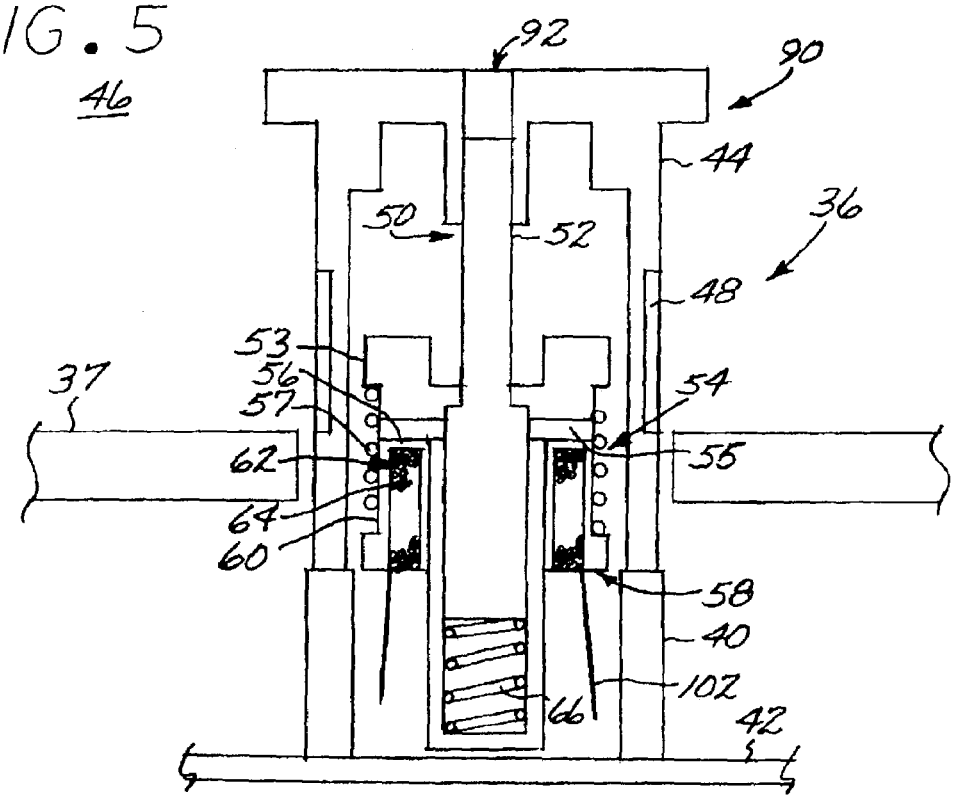
Figure 6:
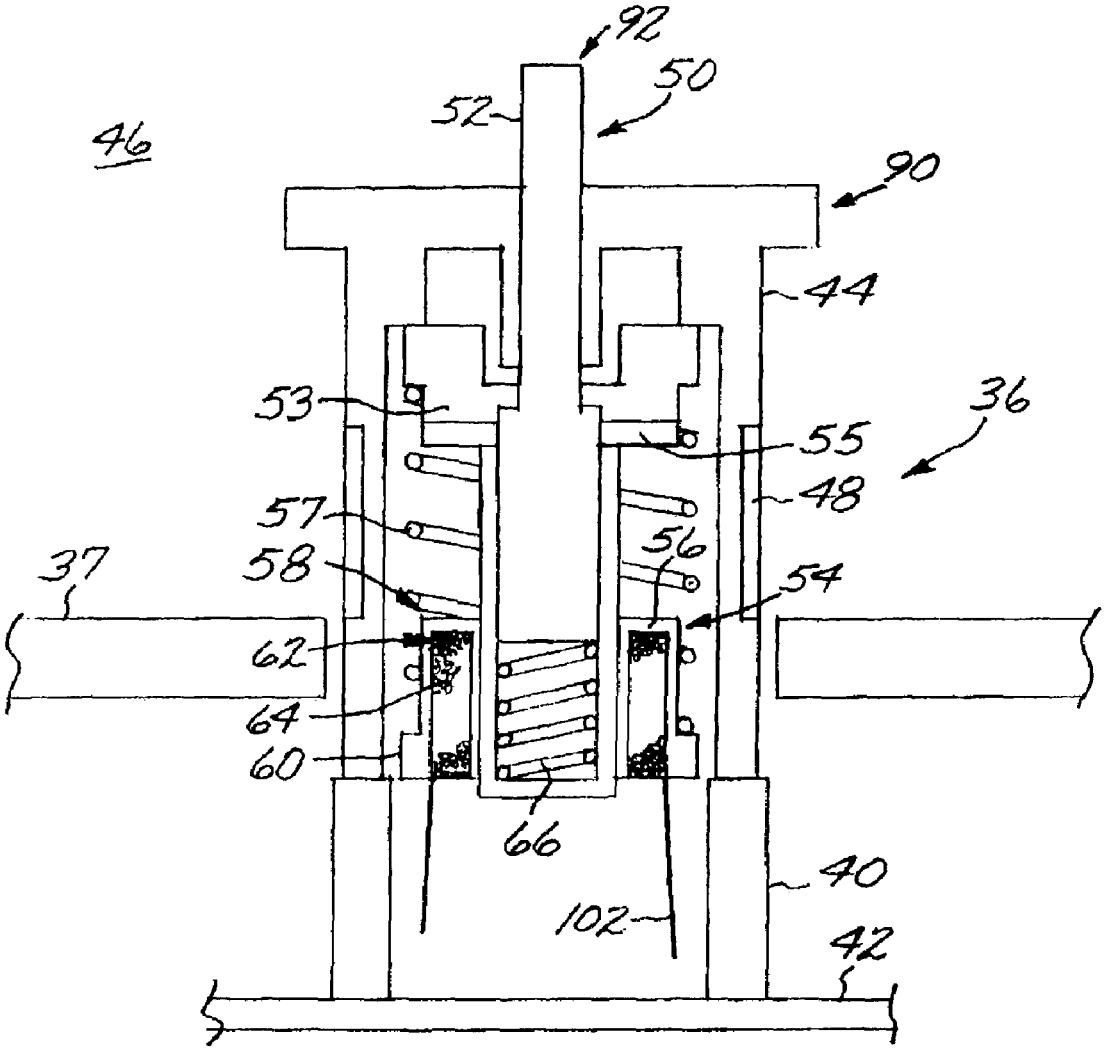

FIGS. 4–6 illustrate the preferred structure of the status indicator structure 36 in greater detail, for its three primary operating positions. FIG. 4 depicts the status indicator structure 36 when the circuit breaker 26 is closed, and the mechanical first movement 90 and the electromechanical second movement 92 are in their retracted positions. FIG. 5 depicts the status indicator structure 36 when the circuit breaker 26 is open due to an overcurrent or manual opening, but not the occurrence of an arc fault, so that the mechanical first movement 90 has moved to an extended position but the electromechanical second movement 92 has not extended beyond its retracted position. FIG. 6 depicts the status indicator structure 36 when the circuit breaker 26 is open due to an arc fault, so that the mechanical first movement 90 is extended (to indicate that the circuit breaker 26 is open for any reason, either an overcurrent or an arc fault) and the electromechanical second movement 92 is extended beyond its retracted position relative to the mechanical first movement 90 (to indicate that the reason for the opening is the arc-fault event). The status indicator structure 36 is depicted in its preferred form as a visual status indicator wherein the circuit breaker status may be quickly determined by visual inspection. This preferred status indicator structure 36 is a two-part pop-up button. The status indicator structure 36 may be used as the switch for an electronic indication of the status instead or in addition.

The preferred status indicator structure 36 comprises a first status indicator element 44 of the mechanical first movement 90 which indicates the opening of the circuit breaker 26 due to the overcurrent fault (or manual opening) when the movable element 42 has moved to the tripped or open position. The first status indicator element 44 also serves as the manual switch of the circuit breaker 26, controlling the opening and closing of the main electrical contacts by being manually pulled out to open or pushed in to close. Conversely, when the circuit breaker 26 is tripped, the first status indicator element 44 is pushed out to the extended position by the action of the internal contact mechanism. To give a clearer indication that the first status indicator element 44 has popped out, a visual marker is preferably provided. In this case, the visual marker is a colored ring 48 that has a contrasting color with the face of the panel 37. The colored ring 48 is applied to the lateral surface of the first status indicator element 44 at a location such that the colored ring 48 is not visible when the circuit breaker 26 is closed, as in FIG. 4, but it becomes visible when the circuit breaker is open for any reason, as in FIGS. 5–6. The colored ring 48 is a readily observed indicator of the open/closed status of the individual circuit breaker. Such an open/closed visual marker is particularly helpful to operating and maintenance personnel, because there may be many, sometimes well over a hundred, circuit-breaker systems 20 protecting individual protected electrical circuits 22, with all of the circuit-breaker systems 20 mounted to the same panel 37 in an aircraft electrical system. The visual marker allows a quick determination of which, if any, of the circuit-breaker systems 20 are open, for any reason.

A second status indicator element 50 portion of the electromechanical second movement 92 indicates the opening of the circuit breaker 26 due to the arc fault. Desirably, the second status indicator element 50 is operable responsive to the circuit-breaker activating element 32, through an electrical signal conveyed over the indicator electrical input signal 38 and a resulting mechanical movement. The second pop-up button of the second status indicator 50 is desirably integral with, but movable with respect to, the first pop-up button of the first status indicator 44.

The second pop-up button of the second status indicator 50 preferably includes a status indicator shaft 52 that is coaxial with and slidably movable relative to and independently of the pop-up button of the first-status indicator element 44, most preferably in an interior bore of the first-status indicator element 44. The status indicator shaft 52 may be made of a material with a contrasting color to the first status indicator element 44, to the colored ring 48, and to the panel 37, have its circumference colored with a contrasting color, or otherwise made more readily visible relative to the first status indicator element 44 when the status indicator shaft 52 protrudes from the first status indicator element 44. The status indicator shaft 52 is laterally encircled by a shaft support 53 that is slidable within an interior bore of the first status indicator element 44.

The second status indicator 50 further includes a shaft retainer 54 that is fixed in location and normally retains the status indicator shaft 52 in a retracted first shaft position illustrated in FIGS. 4 and 5. The shaft retainer 54 preferably is made of a ferrite permanent magnet 56. The portion of the shaft support 53 that comes in facing contact with the shaft retainer 54 preferably is made of magnetized iron, or other magnetic material, in the shape of a small washer 55. The magnetic washer 55 is supported on the shaft support 53 so that it may be positioned in facing contact with the ferrite permanent magnet 56 at one sliding position of the shaft support 53, associated with normal conditions of operation, and may be separated from the permanent magnet 56 when the circuit breaker 26 opens due to an arc fault. The magnetic attraction between the washer 55 and the permanent magnet 56 of the shaft retainer 54 keeps the two pieces together under conditions of operation when the circuit breaker 26 has not opened due to an arc fault.

A shaft activator 58 moves the status indicator shaft 52 away from the shaft retainer 54 and to a second (extended) shaft position responsive to the circuit-breaker activating element 32, as seen in FIG. 6. The shaft activator 58 includes a shaft release 60 that releases the status indicator shaft 52 from the shaft retainer 54 responsive to the indicator actuator signal 102. The shaft release 60 preferably includes an electromagnet 62 activated by the indicator actuator signal 102, when the detector 28 detects an arc fault. The electromagnet 62 includes a winding 64 in electrical communication with the indicator actuator signal 102 and wound to create an electromagnetic field to polarize the ferrite material of the shaft retainer 54 when activated, which causes the magnetized washer 55 of the shaft support 53 to lose its grip on the ferrite permanent magnet 56 of the shaft retainer 54. Magnetic attraction returns when the SCR 100 (or 100*a*/100*b*) ceases to flow current due to the reverse biasing of voltage. A release spring 57 biases the shaft support 53, and thence the status indicator shaft 52, away from the shaft retainer 54.

The nature of the arc-detecting circuitry of the device is such that the electromagnet winding 64 receives an electrical input every time the indicator SCR 100 (or 100*a*/100*b*) is activated by a detected arc. This may be a transient event as has been discussed previously. When the detector 28 produces a trigger pulse, the indicator SCR 100 (or 100*a*/100*b*) is activated, sending a current to the electromagnet winding 64. When current is flowing through the winding 64, the magnetic attraction between the shaft support 53 and the shaft retainer 54 is overcome by the force of the electromagnet 62. In this case, if the indicator elements 44 and 50 were not mechanically restrained from separating while the first status indicator 44 is in the closed position, the spring 57 would push them apart. If the arcing event was indeed a transient, then the current flowing through the winding 64 of the electromagnet 62 will cease flowing as soon as the SCR is reverse biased by the input line power. This will immediately allow the magnetic attraction between the washer 55 and the permanent magnet 56 to once again hold the status indicator elements 44 and 50 together. If an actual arcing event had taken place, the repeating gate trigger signal would activate the indicator SCR 100 (or 100*a*/100*b*) on practically every cycle, both heating the circuit breaker heat-sensitive element with the SCRs 80 (or 80*a*/80*b*) and powering the winding 64 and thus overcoming the attraction between the washer 55 and the ferrite permanent magnet 56. If the heat sensitive element rises in temperature enough to trip the main contacts of the circuit breaker 26, this will cause the first status indicator 44 to start moving to its extended position. This mechanical first movement 90 will also free up the shaft support 53 to move away from the winding 64, allowing the spring 57 to separate the shaft support 53 from the winding 64 before the magnetic attraction returns. Because the indicator SCR 100 (or 100*a*/100*b*) is connected to line voltage, the winding 64 is powered for a short time after the load voltage is switched off, giving the release spring 57 time to react.

If the circuit breaker 26 trips due to a normal current overload without arcing, the arc-fault indicator has no electrical input to negate the magnetic attraction of the indicator components 55 and 56. The circuit breaker 26 opens and the first status indicator element 44 changes states, but the second status indicator element 50 does not change states. The status indicator shaft 52 does not move but effectively recesses into the first status indicator element 44 by the action of the first status indicator element 44 to extend around it. In a similar manner, when the circuit breaker is opened manually by pulling the first status indicator element 44 to its extended position, the status indicator shaft 52 ends up recessed into the first status indicator element 44 because the magnetic attraction between the washer 55 of the shaft support 53 and the shaft retainer 54 was not interrupted or overcome by the action of the manual circuit breaker opening.

As seen in FIG. 4, when the circuit breaker 26 is closed, both the first status indicator element 44 and the second status indicator element 50 are retracted. As seen in FIG. 5, when the circuit breaker 26 is opened for any reason other than an arc fault, the first status indicator element 44 is extended to its popped-out position but the status indicator shaft 52 is not visible. As seen in FIG. 6, when the circuit breaker 26 is opened due to an arc fault, the first status indicator element 44 is extended to its popped out position, indicating that the circuit breaker 26 is open, and the second status indicator element 50 is extended to its popped-out and visible position, indicating that the reason the circuit breaker 26 is open is the occurrence of an arc fault. Operating or maintenance personnel can thereby quickly check the status of the circuit breaker 26. Where there are a number of arc-fault detecting circuit-breaker systems 20 mounted to the panel 37, the checking of the status of all of the circuit breakers is quickly accomplished.

The action of resetting the first status indicator automatically resets the second status indicator 50 by overcoming the resistance of the spring 57, so that the shaft retainer 54 and the shaft support 53 are again contacted together and held together by the permanent magnets. A spring 66 shown within the second status indicator assembly 50 is present to allow the status indicator shaft 52 to retract when the first status indicator 44 is pushed in manually to effect a reset of the circuit breaker. This springed action prevents the possibility of injuring the fingers of operators and maintainers.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An arc-fault detecting circuit-breaker system used in conjunction with a protected electrical circuit whose current flow is to be interrupted upon the occurrence of an overcurrent fault or an arc fault, the arc-fault detecting circuit breaker system comprising:

a normally closed circuit breaker electrically connected to the protected electrical circuit, wherein the circuit breaker comprises a movable element that moves between a first position when the circuit breaker is closed and a second position when the circuit breaker is open;

an arc-fault detector of the occurrence of an arc fault in the protected electrical circuit;

a circuit-breaker activating element operable responsive to the detector, wherein the circuit-breaker activating element creates an overcurrent fault and opens the circuit breaker, in the event that the detector detects an arc fault in the protected electrical circuit; and a status indicator structure comprising:

a first status indicator element which indicates the opening of the circuit breaker due to the overcurrent fault, wherein the first status indicator element is a first-status indicator pop-up button movable responsive to the movement of the movable element of the circuit breaker, and a second status indicator element which indicates the opening of the circuit breaker due to the arc fault, wherein the second status indicator element is a second-status indicator pop-up button integral with the first-status indicator pop-up button and operable responsive to the circuit-breaker activating element, wherein the second status indicator pop-up button comprises:

a status indicator shaft movable relative to the first-status indicator pop-up button, a shaft retainer that normally retains the status indicator shaft in a first shaft position, and a shaft activator that moves the status indicator shaft to a second shaft position responsive to the circuit-breaker activating element.

2. The arc-fault detecting circuit-breaker system of claim 1, wherein the circuit-breaker activating element detects a rate of change of current with time in the protected electrical circuit.

3. The arc-fault detecting circuit-breaker system of claim 1, wherein the shaft retainer normally magnetically retains the status indicator shaft in a first shaft position, and wherein the shaft activator comprises a separating release that releases the status indicator shaft from the shaft retainer responsive to the circuit-breaker activating element, and a spring which biases the status indicator shaft away from the shaft retainer.

4. The arc-fault detecting circuit-breaker system of claim 1, wherein the shaft retainer normally magnetically retains the status indicator shaft in a first shaft position, and wherein the shaft activator comprises an electromagnetic separating release that releases the status indicator shaft from the shaft retainer responsive to the circuit-breaker activating element, and a spring which biases the status indicator shaft away from the shaft retainer.

5. The arc-fault detecting circuit-breaker system of claim 1, wherein the activating element comprises a silicon-controlled rectifier.

* * * * *

UNITED STATES PATENT AND TRADEMARK OFFICE

CERTIFICATE OF CORRECTION

PATENT NO. : 7,126,445 B1
APPLICATION NO. : 10/419573
DATED : October 24, 2006
INVENTOR(S) : Roy P. McMahon et al.

It is certified that error appears in the above-identified patent and that said Letters Patent is hereby corrected as shown below:

Column 1, line 53, delete "comprises" and replace with --compromise--.

Column 5, line 66, delete "SCR (80 of 80a/80b)" and replace with --SCR 80 (or 80a/80b)--.

Signed and Sealed this

Third Day of April, 2007

JON W. DUDAS
*Director of the United States Patent and Trademark Office*